United States Patent [19]

Dwyer

[11] 4,122,760

[45] Oct. 31, 1978

[54] CARTON JAM DETECTION MEANS

[75] Inventor: Gregory J. Dwyer, Livonia, Mich.

[73] Assignee: Ex-Cell-O Corporation, Troy, Mich.

[21] Appl. No.: 731,174

[22] Filed: Apr. 12, 1977

[51] Int. Cl.[2] ..... B65B 57/02

[52] U.S. Cl. ..... 93/36 R; 93/59 ES; 53/507; 116/65

[58] Field of Search ..... 93/59 ES, 44, 44.1 R, 93/36.8, 12 R, 36 R; 53/78; 116/65, 70, 85, 114 PV; 192/129 B

[56] References Cited

U.S. PATENT DOCUMENTS

| | | | |
|---|---|---|---|
| 2,726,583 | 12/1955 | Barnes et al. | 93/44.1 R X |
| 3,187,647 | 6/1965 | Braun | 93/44.1 R |
| 3,382,774 | 5/1968 | Hoff | 93/59 ES |
| 3,452,651 | 7/1969 | Vadas et al. | 93/44.1 R |
| 3,682,129 | 8/1972 | Philbrick | 116/65 |

*Primary Examiner*—James F. Coan

*Attorney, Agent, or Firm*—Mitchell J. Hill; Frank B. Hill

[57] ABSTRACT

A carton jam detector means for use on a carton loader apparatus in a carton packaging machine. The loader push rod has mounted thereon a carrier block which has fixed thereto a valve body having pressurized air passages formed therethrough. A carton lifter finger is pivotally mounted on the valve body and is provided with a vent valve adapted to normally close a valve seat or orifice at one end of said air passages, so as to prevent flow of pressurized air through the air passages. If a carton jam occurs, the lifter finger, which is normally held by a detent means in a position to keep the valve vent closed, is then pivoted by the resistance of the jam to override the detent means and allow air to vent through the open air orifice. The pressure drop in the air flow system is monitored by a system of suitable controls for stopping the loading of cartons until the jam is corrected. The rest of the packaging machine may continue to process the cartons already loaded into the machine.

4 Claims, 4 Drawing Figures

CARTON JAM DETECTION MEANS

BACKGROUND OF THE INVENTION

1. Field of the Invention

This invention relates to coated paperboard carton packaging machines, and generally, to a carton loader apparatus for these machines. The invention is particularly concerned with a carton jam detection means which is adapted to create a signal if a carton jam occurs, and wherein the carton jam signal is monitored by a suitable control system for stopping the carton loader.

2. Description of the Prior Art

It is well known in the coated paperboard carton packaging art to provide a carton loading machine for loading coated paperboard cartons onto mandrels carried on rotating turrets and the like, whereby the cartons are erected and formed before further filling and closing operations. It is well known in the coated paperboard carton packaging art to provide such machines with detection means for detecting carton jams and other problems. However, the prior art detection means function to shut down the entire machine. The shutting down of an entire packaging machine includes the withdrawing of the carton heaters, and accordingly, cartons which are in process must be scrapped because they lose their heat and they cannot be programmed again. The cartons that are lost and which must be scrapped because the entire packaging machine has shut down increases the cost of packaging. Furthermore, the fact that all of the containers on the machine must be removed, and the entire machine reloaded, creates lost production time which entails further economic losses.

SUMMARY OF THE INVENTION

A carton jam detector means is provided for use on a carton loader apparatus in a carton packaging machine. The loader apparatus normally includes a loader push rod, and a carrier block is mounted on the upper end of said push rod. The carrier block has fixed thereto a valve body which is provided with pressurized air passages formed therethrough. A carton lifter finger is pivotally mounted on the valve body, and it is provided with a vent valve that is adapted to normally close a valve seat orifice at one end of the air passages, so as to prevent flow of pressurized air through the air passages. The lifter finger is normally held in a position so as to hold the vent valve against the air flow orifice by an adjustable detent means. In the event that a jam occurs, upon loading of a carton onto a mandrel in the packaging machine, the pivotally mounted lifter finger is pivoted by the resistance of the jam in a direction to override the detent means and open the vent valve, and allow air to vent through the orifice. The pressure drop in the air flow system or air flow passages in the valve body is monitored by a system of suitable controls, which function to stop the loading of cartons into the packaging machine until the carton jam is corrected. All of the cartons that have been fed previously into the packaging machine continue on through the machine and through the normal process of carton forming, filling and closing, without loss of such cartons. The carton jam detection means of the present invention thus permits the carton jam to be detected without stopping the entire packaging machine, and prevents economic loss of the cartons previously loaded on the machine, and without any time loss for removing all of the other cartons and again setting the machine up for starting the packaging process anew.

Other objects, features and advantages of this invention will be apparent from the following detailed description, appended claims, and the accompanying drawings.

DESCRIPTION OF THE PREFERRED EMBODIMENT

Figure 1:
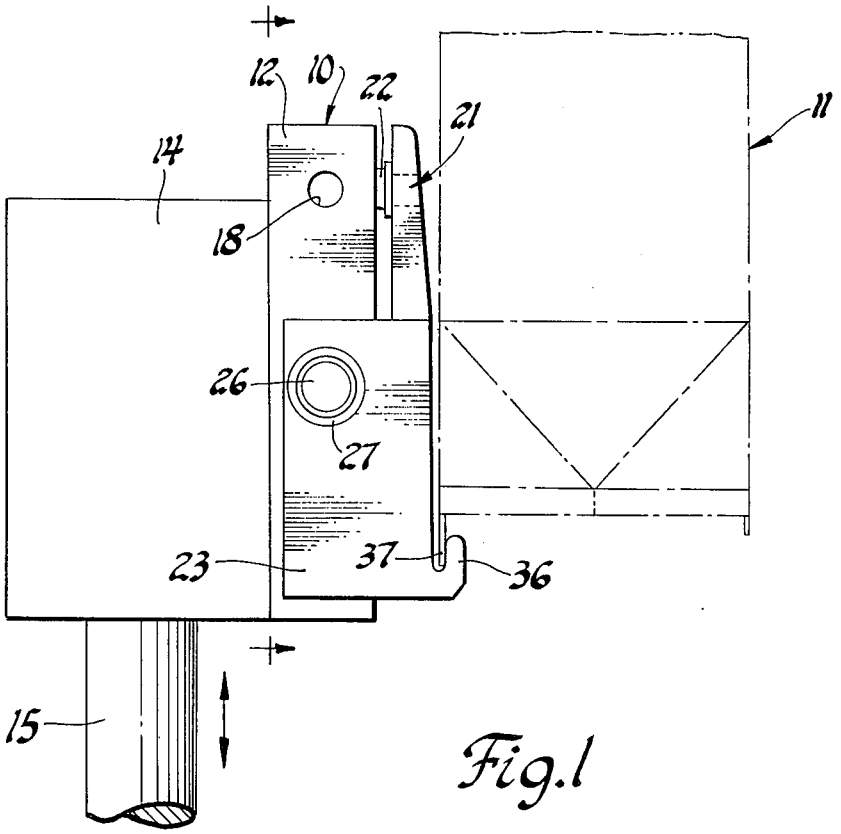
FIG. 1 is a side elevation view of a carton jam detection means made in accordance with the principles of the present invention.
Figure 3:
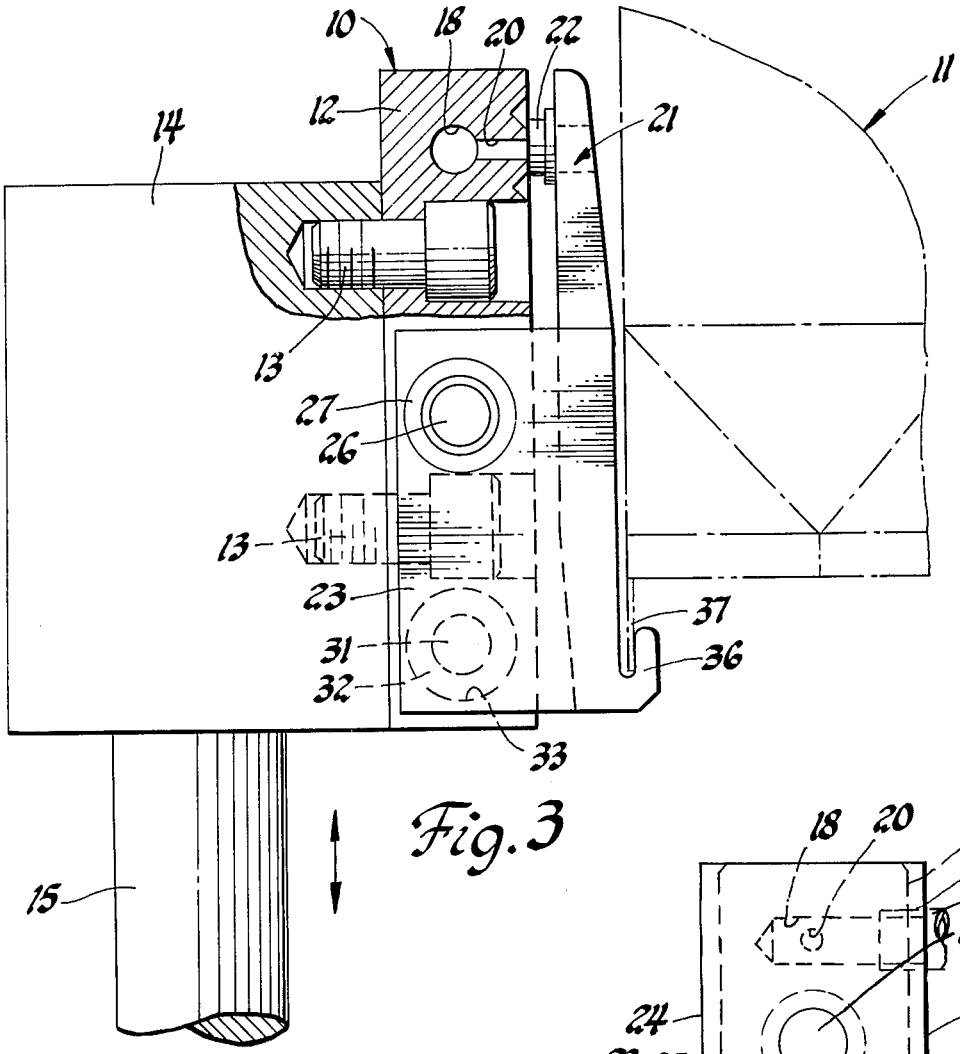
FIG. 3 is a side view, similar to FIG. 1, but with parts in section and hidden parts added in broken lines.
Figure 4:
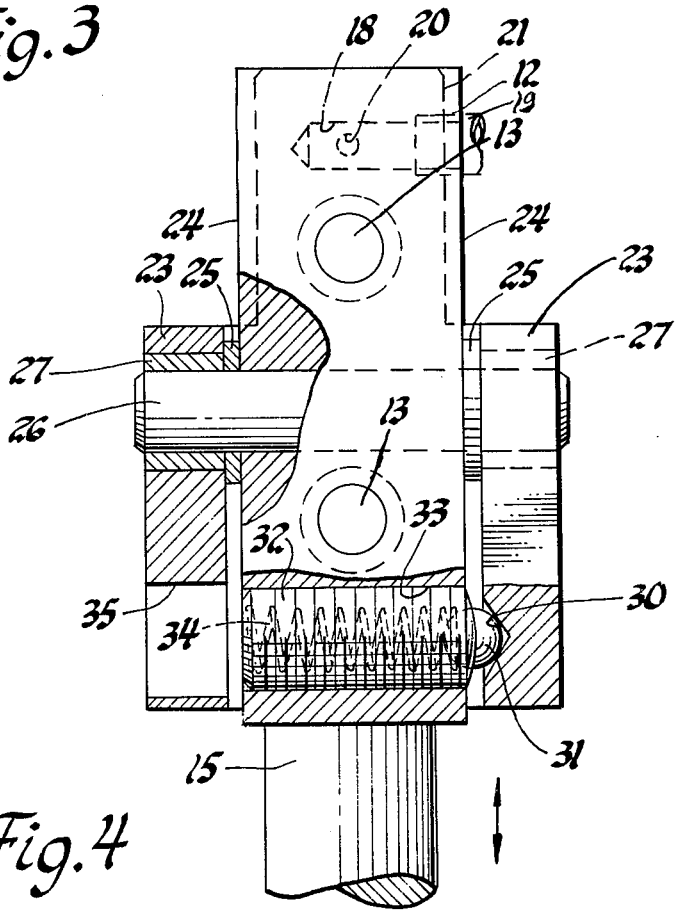
FIG. 4 is an elevation view of the structure illustrated in FIG. 1, taken along the line 4—4 thereof, looking in the direction of the arrows, and with parts broken away and parts in section.

Referring now to the drawings, and in particular to FIGS. 1 and 3, the numeral 10 generally designates a jam detector means made in accordance with the principles of the present invention. The numeral 11 generally designates a carton which is loaded by a loader means into a packaging machine for further processing. As shown in FIGS. 3 and 4, the numeral 12 designates a rectangular valve body which is fixedly secured, as by machine screws 13, to a carrier block 14 that is fixedly mounted by any suitable means on the upper end of a lift rod or push rod 15. The push rod 15 comprises the normal push rod employed in a carton loader apparatus.

As best seen in FIGS. 3 and 4, the valve body 12 is provided with an inlet air bore or passage 18 which is adapted to be connected by a conduit 19 to a suitable source of pressurized air. However, it will be understood that a vacuum could be used. As shown in FIG. 3, a second air passage 20 communicates the air passage 18 with the front end of the valve body 12, and the outer end of passage 20 forms a valve seat orifice which is adapted to be normally closed by a suitable vent valve member 22 that is operatively mounted on a lifter finger, generally indicated by the numeral 21. The vent valve 22 may be made from any suitable material, as for example, an elastomeric material.

The lifter finger 21 is provided with a pair of integral pivot arms 23, on the lower side thereof, and which arms extend rearwardly on the opposite sides 24 of the valve body 12. The pivot arms 23 are spaced from the sides 24 of the valve body 12 by suitable spacer washers 25. A transverse pivot shaft 26 is carried by the valve body 12, and it is fixed in position by any suitable means, as by a press fit. The lifter finger pivot arms 23 are pivotally mounted on the outer ends of the pivot shaft 26 by suitable sleeve bearings 27. As best seen in FIG. 4, one of the pivot arms 23 is provided with a detent ball recess 30 on the lower inner side thereof, which is adapted to receive a detent ball 31. The detent ball 31 is carried in a spring housing 32 which is threadably mounted in a transverse bore 33 formed through the lower end of the valve body 12. The spring housing 32 operatively carries therein a detent spring 34. It will be seen that the spring pressure on the detent ball 31 may be adjusted by adjusting the spring housing 32 toward or away from the detent ball 31 by a suitable Allen wrench. An access hole 45 for an Allen wrench is formed through the other pivot arm 23, and it is aligned with the threaded bore 33.

As shown in FIGS. 1 and 3, the lifter finger 21 is provided on the lower outer front face with a lifter finger lip 36 for operative engagement with a fold-over flap 37 of a carton 11 for moving the carton 11 upwardly and loading it onto a carton forming mandrel in a packaging machine.

Figure 2:
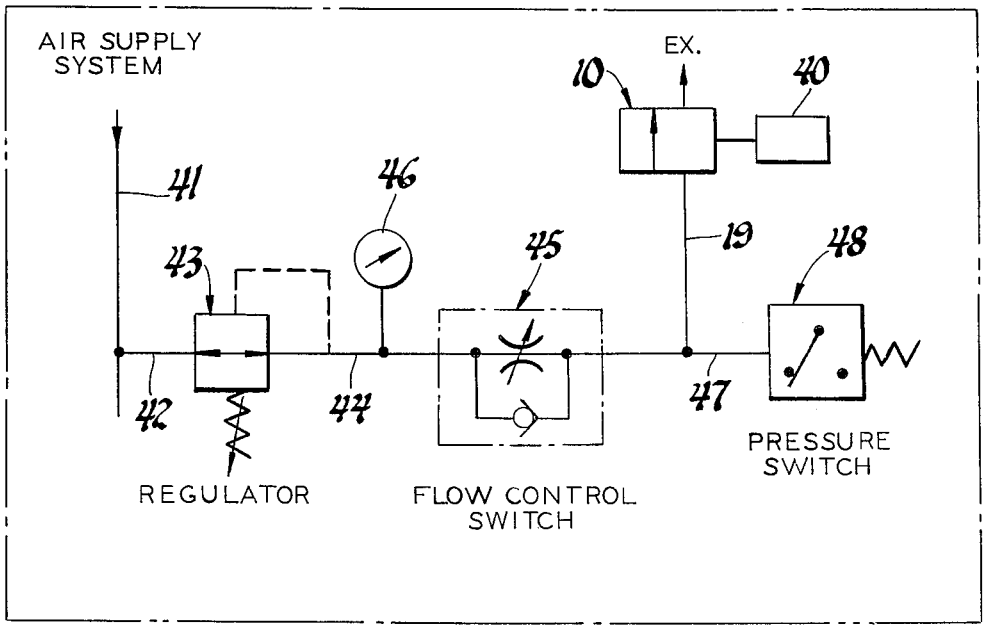
FIG. 2 is a schematic view of an illustrative control circuit that may be employed with the carton jam detection means of FIG. 1.

FIG. 2 shows an illustrative control circuit which may be employed with the jam detection means 10 of the present invention. In the control circuit shown in FIG. 2, the numeral 40 indicates a carton jam which provides the resistance to pivot the lifter finger 21 in a counterclockwise direction, as shown in FIGS. 1 and 3, so as to move the vent valve 22 away from the valve seat orifice at the end of the air passage 20 and permit air to be vented therethrough. Air is supplied to the jam detection means from a suitable air supply through conduits 41, 42, 44, 47 and 19, a flow regulator 43, and a flow control switch 45. A suitable air gage 46 is provided in the conduit 44. The conduit 47 is also connected to a suitable conventional pressure switch 48 which would be moved to an inoperative position by air pressure and to an operative signal producing position by spring pressure.

In use, if upon loading a carton 11 onto a mandrel in a carton packaging machine, the carton jams, then the resistance of the jammed carton will cause the lifter finger 21 to pivot counterclockwise, as viewed in FIGS. 1 and 3, which would move the valve 22 off the valve seat orifice at the end of the air passage 20. In the control circuit of FIG. 2, the jam detector 10 would be operated so as to open the conduit to the exhaust line which would relieve the pressure on the pressure switch 48 and cause a suitable alarm signal to be given, and to shut down the operation of the carton loader apparatus only, without stopping the rest of the packaging machine. The pressure drop in the control system indicates a jam, and this pressure drop may be monitored by other suitable controls than those shown in FIG. 2. It will be understood that any suitable sensing device may be employed which produces a detectable signal caused by the opening of the valve 22, regardless of whether the signal is a positive or a negative signal.

While it will be apparent that the preferred embodiment of the invention herein disclosed is well calculated to fulfill the objects above stated, it will be appreciated that the invention is susceptible to modification, variation and change.

What is claimed is:

1. In a coated paperboard carton packaging machine having a carton loader apparatus, including a carton lift rod, the combination comprising:

(a) a valve block mounted on said lift rod and having pressurized air passages formed therethrough and having an inlet end adapted to be connected to a source of an air supply system, and having an outlet end forming a valve seat orifice;

(b) a carton lifter finger movably mounted on said valve body;

(c) vent valve means carried on said lifter finger for normally enclosing said valve seat orifice when the lifter finger is in a releasable carton loading position; and, (d) means for normally biasing said lifter finger into said releasable carton loading position to maintain said vent valve on said valve seat orifice, whereby when a carton jam appears during the loading of a carton on a mandrel, the resistance of the carton jam will pivot the lifter finger from said releasable carton loading position to a position whereby the vent valve means is moved off of the valve seat orifice and air is permitted to vent to the atmosphere through the valve seat orifice and provide a control signal.

2. In a coated paperboard carton packaging machine, as defined in claim 1, wherein:

(a) said carton lifter finger is pivotally mounted on said valve body.

3. A coated paperboard carton packaging machine, as defined in claim 2, wherein:

(a) said means for normally biasing said lifter finger into a releasable carton loading position comprises a detent means.

4. A coated paperboard carton packaging machine, as defined in claim 3, wherein:

(a) said detent means is an adjustable detent means.

* * * * *